United States Patent [19]

Gajjar

[11] 4,026,130

[45] May 31, 1977

[54] METHOD OF WARP KNITTING

[75] Inventor: Bharat Jaybhadra Gajjar, Wilmington, Del.

[73] Assignee: E. I. Du Pont de Nemours and Company, Wilmington, Del.

[22] Filed: Oct. 8, 1975

[21] Appl. No.: 620,833

[52] U.S. Cl. ..... 66/203; 66/207

[51] Int. Cl.[2] ..... D04B 23/00; D04B 27/00

[58] Field of Search ..... 66/209, 203, 207, 213, 66/190–195

[56] References Cited

UNITED STATES PATENTS

| | | | |
|---|---|---|---|
| 1,234,927 | 7/1917 | Myers et al. | 66/195 |
| 2,932,181 | 4/1960 | Macaffray | 66/84 R |
| 3,055,196 | 3/1969 | Auville et al. | 66/86 R |
| 3,063,272 | 11/1962 | Bolton | 66/86 |
| 3,254,510 | 6/1966 | Lesley | 66/195 |
| 3,255,615 | 6/1966 | Schwartz | 66/195 X |
| 3,861,175 | 1/1975 | Farmer | 66/86 A |

*Primary Examiner*—Ronald Feldbaum

[57] ABSTRACT

A warp-knitted fabric with surface interest patterning is formed from at least two full sets of threads being fed to separate guide bars of a warp knitting machine then to a single needle bed for knitting by supplying one of the full set of threads from two partial beam sets of threads. The two partial beam sets of threads are fed at different rates to the operating guide bar in a pattern. The pattern is predetermined groups of threads from one partial beam set of threads with each group being separated by at least one thread from the other partial beam set of threads.

10 Claims, 15 Drawing Figures

STITCH
FRONT BAR
BACK BAR
FIG. 1A JERSEY
2-3, 1-0
41
1-0, 1-2
42
FIG. 1B MODIFIED JERSEY
1-0, 2-3
2-3, 1-0
FIG. 1C REVERSE JERSEY
1-0, 1-2
2-3, 1-0
FIG. 1D LONG-FLOAT JERSEY
3-4, 1-0
1-0, 1-2
FIG. 1E STABILIZED
1-0, 0-1
3-4, 1-0
FIG. 1F TAFFETA
1-0, 0-1
1-0, 4-5
FIG. 1G SHORT-FLOAT DELAWARE
1-2, 1-0
1-0, 0-1
FIG. 1H DELAWARE
2-3, 1-0
1-0, 0-1
FIG. 1I LONG-FLOAT DELAWARE
3-4, 1-0
1-0, 0-1
FIG. 1J SATIN-FLOAT DELAWARE
4-5, 1-0
1-0, 0-1
0 1 2 3 4 5
0 1 2 3 4 5

METHOD OF WARP KNITTING

BACKGROUND OF THE INVENTION

This invention relates to warp knitted fabrics and more particularly to the method of knitting the fabrics to produce surface interest patterning.

Basic warp-knitting, to which this invention applies, comprises knitting on tricot or Raschel machines using basic plain stitches, for example, Jersey or Delaware stitches, or their well-known variations. These knitted fabrics are characterized by unvarying stitch formation; i.e., all stitches in a given course are identically formed, and each course is formed exactly the same as alternating courses before and after it in the fabric. The front-bar and back-bar stitch patterns are different, but each starts in one course, ends in the next, and repeats for succeeding pairs of courses. Basic warp-knitting permits very high production rates, but the fabrics have only plain surface aesthetics free of any surface-interest patterning. The prior art includes many techniques for forming surface patterns in warp-knitting fabrics, but all of these known techniques involve complicated variation in stitch patterns, the laying in of extra ends in pattern-forming arrays, or like complications which diminish productivity and add to the cost of fabrics produced.

SUMMARY OF THE INVENTION

This invention provides a method for preparing fabrics having spaced warpwise visible line patterns using basic warp-knitting stitch constructions with their inherently high productivity rates. It also provides a warp-knitted fabric with spaced warpwise visible line patterns. These advantages result from an improvement on a method for producing warp knitted fabrics on a warp knitting machine having two sets of warp threads, that includes the steps of feeding one of the two sets of threads to one of two operating guide bars of the warp knitting machine and feeding the other of the two sets to the other operating guide bar of the warp knitting machine to form a knitted fabric. The improvement comprises: supplying one of the two full sets of threads from two partial beam sets of threads; the two partial beam sets of threads are fed at different rates to the operating guide bar in a pattern. The pattern is predetermined groups of adjacent threads from one partial beam set of threads with each group being separated from the next by at least one thread from the other partial beam set of threads.

DETAILED DESCRIPTION OF THE PREFERRED EMBODIMENT

"Basic warp-knitting," as intended herein, is best defined in terms of stitch patterns, as shown in FIGS. 1A to 1J. While many other patterns constituting basic warp-knitting are theoretically possible, the ones shown represent most of those used commercially. For each, a single needle-bar is employed, being fed from front-bar and back-bar warps of knitting yarns or threads. Knitting needle positions for each of two successive courses are represented in the diagrams by horizontal lines of dots, the top line representing the course formed immediately after the course represented by the bottom line. Only one front-bar and one back-bar yarn are shown in each instance, it being understood that one end of each is knitted on each knitting needle for every course. More particualarly, referring to FIG. 1A the stitich construction of the fabric is notationally set out and shows that the threads of the front bar, one of which is indicated at 41, have back and forth movement to non-adjacent needles in successive courses as indicated by the numbers 2-3,1-0 and that the threads of the back bar, one of which is indicated as 42, have similar movements as indicated by the numbers 1-0,1-2. The Delaware stitches are particularly characterized by chain-stitched back bar threads as indicated by the numbers 1-0,0-1 (FIGS. 1G-1J). These may be open stitches (as shown) or closed loops.

The fabric is preferably made according to the invention on a tricot or similar warp knitting machine employing a single needle bar and at least two yarn guide bars respectively known as the back guide bar and the front guide bar. The needle bar is provided with knitting needles which may vary in number according to the gauge of the machine, and each guide bar has a number of yarn guides corresponding to the number of needles of the needle bar. The guide bars are able to be shogged under pattern control a distance of one or more needles in opposite directions lengthwise of the needle bar, and both bars are also swingable transversely of the needle bar to permit their yarn guides to pass between the needles, the combined shogging and swinging movements permitting the yarns to be fed to the needles and to be knit thereby.

Figure 2:
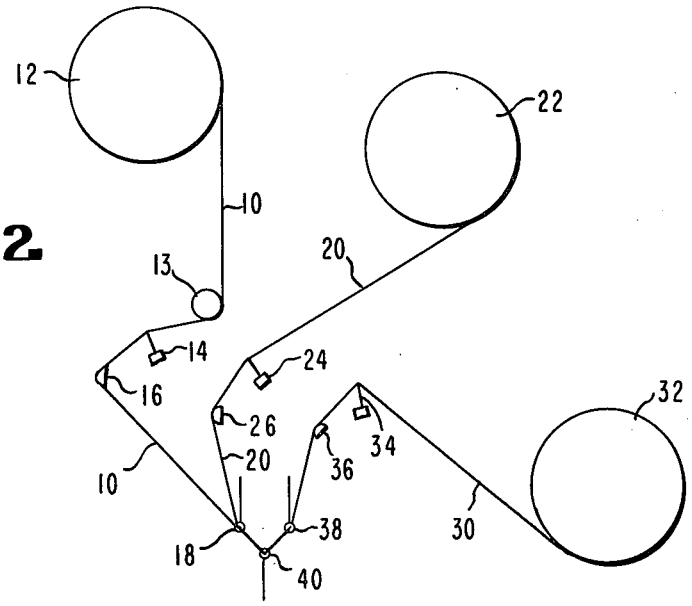
FIG. 2 is a schematic end elevation of the apparatus elements for basic warp knitting.
Figure 3:
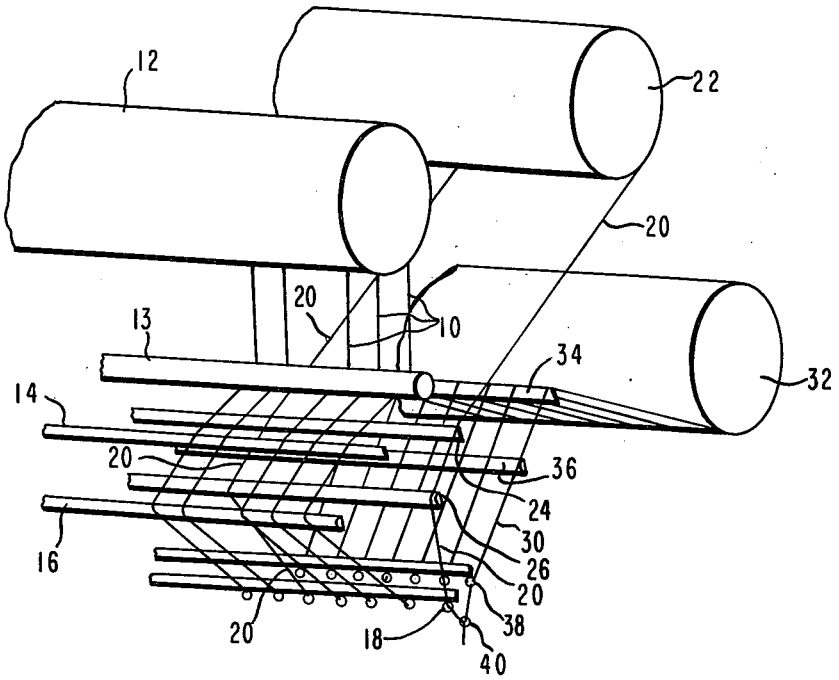
FIG. 3 is a partial front isometric view of FIG. 2 without the needle bed.

A schematic illustration for such a warp-knitting machine is shown in FIGS. 2 and 3. The front bar warp is fed from partial warp-sets of yarns or threads 10 and 20 on beams 12 and 22. The threads 10 pass in the usual well-known manner around a direction changing bar 13 through a fixed reed 14 which serves to keep the threads separated in open dents (not shown) and over tension-bar 16 which has a smooth yarn-contacting surface extending across the whole width of the warp. The tension bar is flexibly mounted so as to vibrate and thus tend to equalize tensions on the threads. From tension-bar 16, each thread 10 is then threaded through its guide in guide-bar 18 and on to needle-bed 40. The other partial warp set of threads 20 is fed from middle beam 22 via fixed reed 24, tension bar 26 and front guide bar 18 to the needle-bed 40. Similarly, the back-bar warp is fed from a warp-set of yarns or threads 30 on beam 32 via fixed reed 34, tension-bar 36, and back guide-bar 38 to needle-bed 40. Knitting results from two kinds of motion, as is well known. The two guide-bars 18, 38 swing back and forth together along an arc in the plane of FIG. 2, and each is separately shogged into and out of the plane of FIG. 2 according to a preselected pattern.

The provision of warpwise line patterns in basic two-bar warp-knitted fabrics according to this invention results from basic two-bar warp knitting with one bar (preferably the back bar 38) being fed from a full warp-set of knitting yarns and the other bar (preferably the front bar 18) being filled in patterned fashion from two partial beam warp-sets of knitting yarns 10, 20 with unequal rates of feeding which provides differences in tension on the threads in warp sets 10, 20. One method of setting forth these differences in tension is by the ratio R of the runner length of one partial beam (the middle beam) set of threads 20 to the runner length of the other partial beam (the top beam) set of threads 10. Runner length is the number of inches of each yarn used in knitting one rack (480 consecutive courses) of stitches. Preferably the ratio R is in the range of from about 0.5 to about 1.5. If the threads 10 and 20 have different retraction and/or shrinkage properties, differences in tension arising from these sources also contribute to the patterning effects either before or during fabric finishing. By "patterned" is meant that predetermined groups of ends from one partial warp-set are separated by one (or more) end from the other partial warp set to provide a patterned distribution at the guide-bar. For example, in FIG. 3 threads 10 from partial warp beam 12 fill the second, third, and fourth positions of front guide bar 18 while threads 20 from partial warp beam 22 fill the first and fifth positions of the guide bar 18.

When the method of this invention is used with Delaware stitch constructions which have a tendency toward instability characterized by random wale groupings in scattered areas of the fabric, it has been found that uniform wale shifting is induced such that stable and uniform wale groupings occur throughout the fabric along its entire length. In other words, the effect of this wale shifting is the formation of walewise stripes formed by groups of closely spaced wales separated by open areas of generally coursewise extending portions of knitting yarn. The number of wales in each closely spaced group is a function both of the number of needles per float of the Delaware stitch used and of the number of normal-tension ends between pairs of underfed or overfed ends in the warp formed from the two partial warp-sets. Thus, if a three-needle float Delaware stitch (FIG. 1H) is employed and the top-guide-bar has groups of six ends of yarn from a first partial warp-beam separated by single ends underfed from a second partial warp-beam, the knitted fabric has three-wale groups, each including an underfed end, separated by two two-wale groups devoid of underfed ends. A repeat of the above except for using groups of five ends separated by differently tensioned single ends provides stripes of three-wale groups, each including a differently tensioned end, across the whole width, separated by three normally spaced wales. A variety of striped-like patterns is obtainable by varying the number of needles per float and/or the spacing of differently tensioned ends.

This invention capitalizes on the normally undesirable tendency for Delaware warp knits to undergo wale shifting. By feeding partial warp-sets to one guide-bar, so that underfed (or overfed) yarns occur in spaced patterned arrangement along the guide-bar, wale-shifting stitch distortions are caused in the group of adjacent wales including the differently tensioned end and corresponding to its float length. These distorted wales force all the wales to shift in a regular stable manner to yield visually identifiable stripes in the fabric. Thus, patterned fabrics are readily obtainable using high-speed Delaware stitch constructions whereas similarly patterned warp knits had heretofore required knitting at slow speeds with complicated stitch constructions.

While the illustrated embodiment shows the preferred arrangement with two partial beam sets of threads being fed to the front guide bar 18 of the knitting machine, alternatively the situation could be reversed with the two partial beam sets of threads being fed to the back guide bar 38 creating similar patterns in the fabric.

While it is preferred that the process of this invention be carried out on knitting machines having two guide bars and a single needle bar, it is apparent to those skilled in the art that knitting with multiple guide bars and/or two needle bars also can produce similar patterning using the invention. It is required only that spaced ends be omitted at the guide bar from an otherwise fully threaded warp supply, and that the omitted ends be replaced by ends fed from an independent partial warp supply.

Any yarns useful for known warp-knit processing may be used in making fabric according to this invention. Included are synthetic thermoplastic yarns in either filament or spun-staple form, yarns spun from natural fibers, and yarns from mixtures of synthetic and natural fibers.

Conventional finishing procedures are suitable for frabrics made according to this invention. In the examples, except for random selection of color of the disperse dyes used, all greige fabrics are finished identically. After heat setting for 30 seconds at 380° F (193° C) on a pin tenter frame at 10% overfeed and 5% underwidth, they are scoured, washed, dyed, and again washed in a beck. Scouring is for 30 minutes at 180° F (82° C) using an aqueous dispersion of surfactant and emulsified hydrocarbon scouring solvent. Initial washing is for twenty minutes at 160° F (71° C) in water containing detergent. After 5 minutes at 120° F (49° C) in water containing wetting agent, dispersing agent, and a dye assist, pH is adjusted to 6 with acetic acid, the selected dye is added, and temperature is raised to 160° F (71° C) before adding butyl benzoate dye carrier. Dyeing continues at the boil for 90 minutes. Final washing identical to initial washing ends treatment in the beck. Finishing is completed by heat setting at 350° F (177° C) on a pin tenter frame at wet width and 5% overfeed.

The following terms are used in the Examples and are defined below:

*Rack* is defined as 480 consecutive courses (Knitted rows) of stitches.

*Runner length* is the length of each yarn used in knitting one rack.

*Quality* denotes the length of one rack of knitted fabric.

*Gauge* specifies the number of knitting needles per inch (per 2.54 cm) in the needle bar.

*Count* (*W/C*) specifies the number of wales (W) and courses (C) per unit of length measured perpendicular to the fabric direction of each.

*Greige* (also, occasionally, "gray" ) describes untreated fabric just as it comes from the knitting machine. Before it is sold, the greige fabric is ordinarily treated by washing, scouring, dyeing, heat-setting, or the like, after which it is referred to as "finished" fabric.

*Bulk* is computed from weight per unit area, W, and from thickness, *t*, according to $$\text{Bulk} = (t/W) \times (\text{units conversion factor})$$ When W is given in oz/yd² and *t* inches, Bulk in cc/gm is computed from Bulk = (t/W) × 748.5.

In the examples, Yarns A and B are both of 30 denier (33.3 dtex) and are prepared substantially as described in Example I of Knospe, U.S. Pat. No. 3,416,302. Each filament has a trilobal cross-section as taught by Holland in U.S. Pat. No. 2,939,201. Yarn A has 10 filaments, and Yarn B has 18 filaments. In each yarn, half of the filaments are composed substantially or PACM-12 homopolymer and the outer half of PACM-12/PACM-I (90/10 by weight) copolymer. PACM denotes the polymer unit corresponding to bis-(4 -aminocyclohexyl) methane; 12 denotes the polymer unit corresponding to dodecanedioic acid; and I denotes the polymer unit corresponding to isophthalic acid. The PACM employed contains 70% by weight of its trans-trans isomer.

Yarn C is provided on partial beams only and is a commercially available crimped 30 denier (33.3 dtex) round cross-section monofilament of poly-ε -caproamide. It is crimped as described by Rice in U.S. Pat. No. 3,256,134.

In the examples, a commercial 32 gauge two-bar single needle bed warp knitting machine is employed. Three beams of knitting yarn are fed. The back beam 32 fully threads the back guide bar 38. A partial top beam 12 nearly fills the front guide bar 18 but leaves preselected spaced positions unthreaded. A partial middle beam 22 feeds one end to each of the preselected spaced positons of the front guide bar, thus rendering it also fully threaded. Surface effect patterns formed in the knitted fabrics result when the ratio (R) of middle-beam to top-beam runner lengths is less than or about 1.00. The intensity of the patterns also increases when, relative to the top-beam yarns, the middle-beam yarns retract more on relaxation from knitting tensions, shrink more during finishing, or are of quite different effective diameter.

EXAMPLE I

Figure 1:
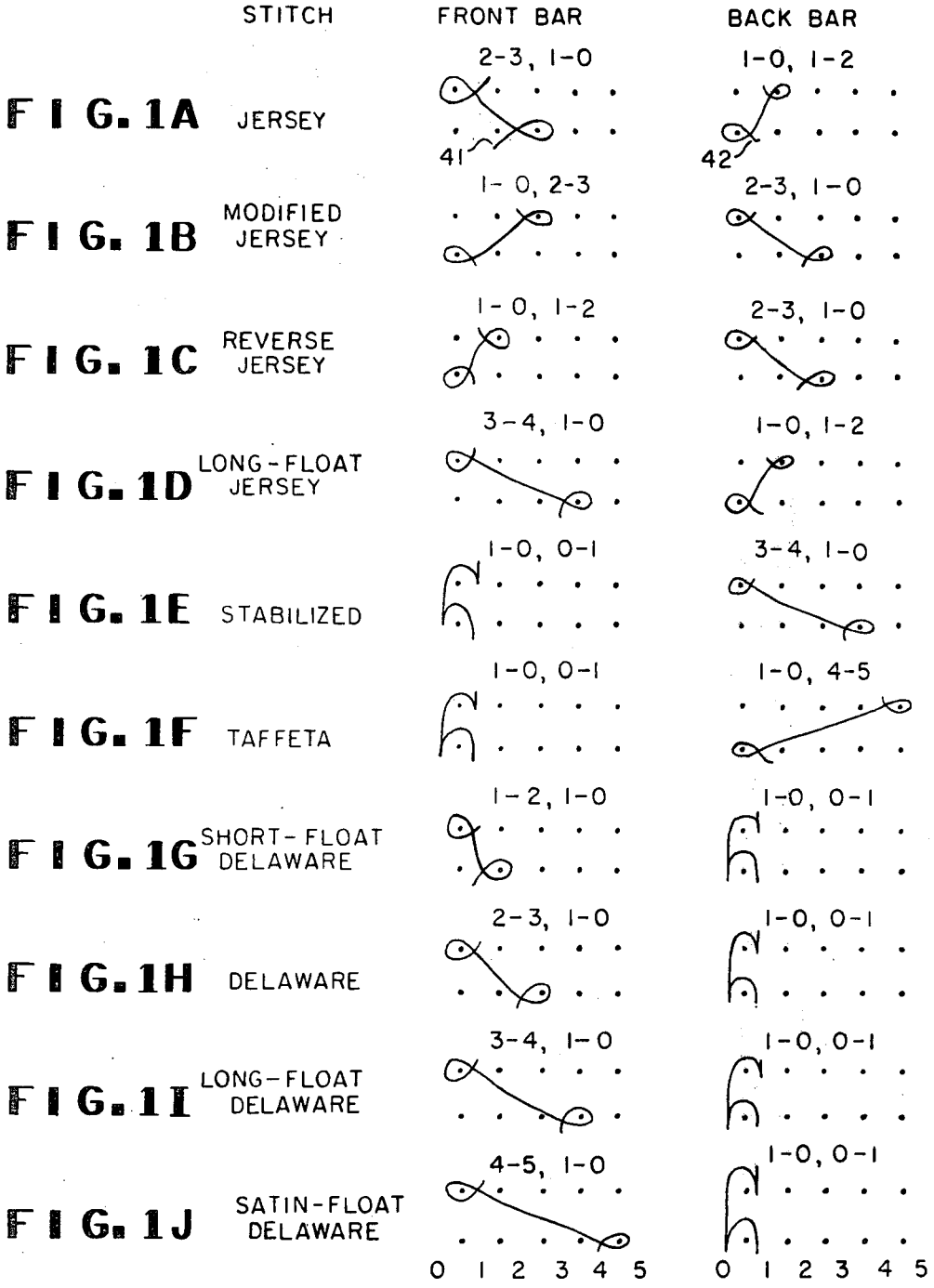
FIGS. 1A to 1J are stitch pattern diamgrams for different types of basic warp-knitting with the front and back bars of each stitch construction shown separately.
Figure 4:
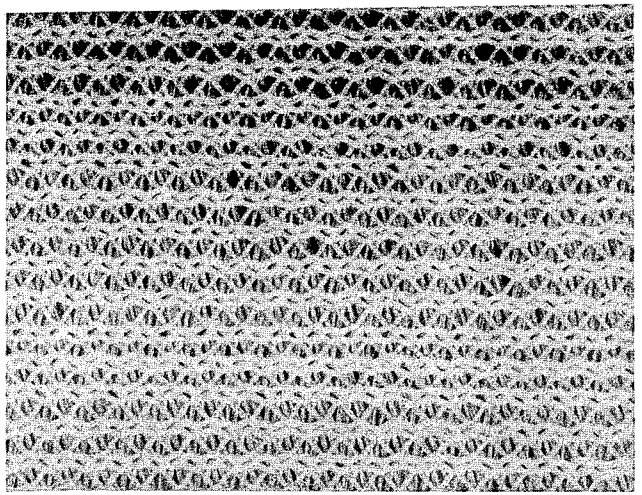
FIGS. 4, 5 and 6 are photographs of fabric made as described in Example I.
Figure 5:
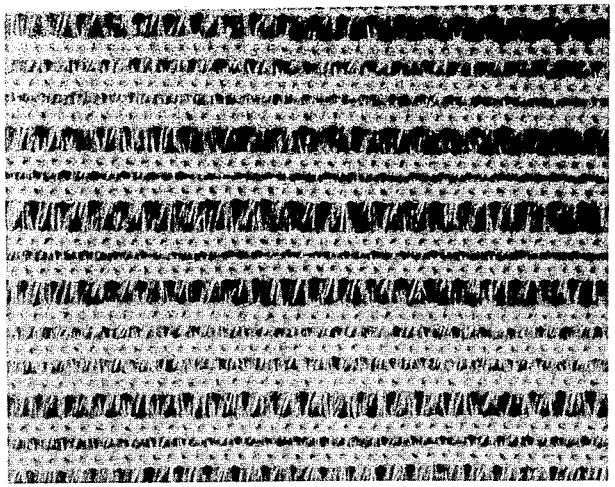
Figure 6:
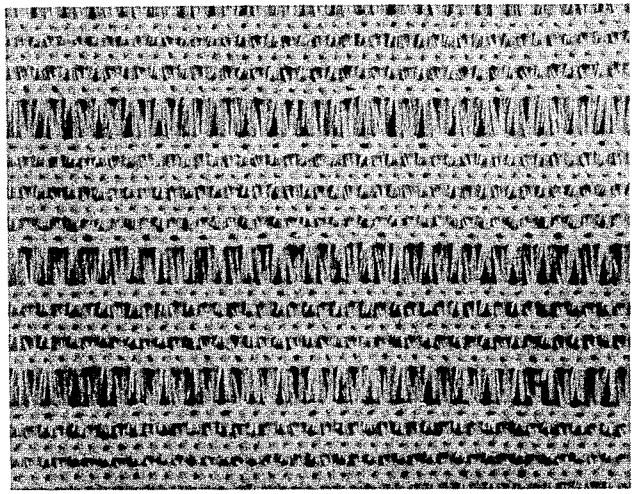

Three fabrics are knitted, each having six zones with different frequencies of middle-beam threads in the front guide bar as follows:

zone 1 every fourth thread
zone 2 every fifth thread
zone 3 every sixth thread
zone 4 every seventh thread
zone 5 every eighth thread
zone 6 every ninth thread, Fabric 1-A uses the Jersey stitch, FIG. 1A; Fabric I-B the Delaware stitch, FIG. 1H; and Fabric I-C the Long-Float Delaware stitch, FIG. 1I. Knitting parameters are shown in Table 1 and fabric characterizations in Table 2. FIGS. 4, 5, and 6 are enlarged photographs of the three Zone 4 portions of Fabrics I-A, I-B and I-C, respectively. In Fabrics 1-A and I-B, each middle-beam end is knitted into three adjacent wales, thus creating a distinguishable 3-wale grouping. In Fabric I-C, each middle beam end is knitted into four adjacent wales, thus creating a distinguishable 4 -wale grouping.

All of the wales of the Zones of Fabric I-A have loops that are distorted in zig-zag fashion along each wale line (FIG. 4). The wales in each 3-wale grouping are characterized as follows:

1. they tend to be slightly closer together than wales not included in 3-wale groupings;
2. the outside two wales in each 3-wale grouping have relatively normal loops in that they zig-zag very little along wale lines;
3. the center wale of each 3-wale grouping is substantially identical to wales outside the grouping; and
4. wales occurring between 3-wale grouping are identical, uniformly spaced from one another, and have sharply zig-zagged loops along each wale line.

The distorted stitches clearly differentiate this fabric from prior art Jersey fabrics, but the longitudinally striped effect of the 3-wale groupings is rather subdued.

The two Delaware stitch fabrics (I-B and I-C) undergo wale shifting more readily with the result that sharply defined striped effects are produced by uniform wale groupings. In each case the individual wales closely resemble each other and are composed of tightened knit loops.

In Zones 1, 3, and 5, Fabric I-B, the 3-wale groupings alternate with 1, 3, and 5 wales, respectively, uniformly spaced from each other but set off from each 3-wale grouping by an extra-wide interwale spacing. Each 3-wale grouping is additionally split into 2-wale and 1-wale groupings by a slight widening for one interwale spacing.

In Zones 2, 4 and 6 of Fabric I-B a quite different effect obtains. The wales in each 3-wale grouping shift closer together are evenly spaced. Also, the even number of extra wales between adjacent 3-wale groupings shift to form the appropriate number of closely spaced 2-wale groupings. Thus, Zone 2 has 3×2 wale groupings, Zone 4 (see FIG. 5) has ×2×2 wale groupings, and Zone 6 has 3×2×2×2 wale groupings. The interwale spacings between adjacent groupings are all wide; i.e., at least as wide as the loop chains defining each wale.

Similar effects are obtained for Fabric I-C. Zone 1 has only tightly spaced 4-wale groupings separated by extra-wide interwale spacings (about 2 wale-widths wide). Zone 4 (see FIG. 6), with three extra wales between 4-wale groupings, has alternating wale-shifted 4-wale and 3-wale groupings all separated by extra-wide interwale spacings. In Zones 2, 3, 5, and 6 where the number of extra wales between 4wale groupings is not evenly divisible by three, different wale-shifting occurs. The 4-wale groupings of Zones 2 and 5 split into two 2-wale groupings with the result that 2×2×1 separate groupings form in Zone 2 and 2×2×1×2×1 separate groupings form in Zone 5. The 4-wale groupings of Zones 3 and 6 split into 1- and 3-wale groupings with the result that 1×3×2 wale groupings form in Zone 3 and 1×3×2×1×2 wale groupings form in Zone 6.

It is apparent that, by varying the frequency with which middle-beam ends are fed to the front guide bar, a great variety of wale-shifted patterning effects can be obtained.

EXAMPLE II

Six fabrics are prepared substantially as described in Example I. All use front guide bars with every seventh position threaded by middle-beam yarn and the remaining positions threaded with top-beam yarn. With reference to Table 1, Fabrics II-A, -C, and -E are all knit using Yarn B in the top and the back beams and textured Yarn C in the middle-beam. Fabrics II-B, -D, and -F use the same top and back beams, but the middle beam feeds untextured Yarn A. With each of these two setups, again with reference to Table 1, a fabric is knitted using the Delaware stitch (Fabrics II-A and II-B), another is knitted using one modified Delaware stitch (Fabrics II-C and II-D), and a third is knitted using a differently modified Delaware stitch.

The wale-shifted patterns obtained for Fabrics II-A and II-B are exactly as described in Example I for Zone 4 of Fabric I-B (see FIG. 5).

In Fabrics II-C and II-D, the wales of each 7-wale repeat are wale-shifted into 3×1×3 wale groupings. The interwale spacing between adjacent 3-wale groupings is very wide (about as wide as each 3-wale grouping). The interwale spacings on either side of each 1-wale grouping are unequal in width, smaller than the others, but strikingly distinct. Each wale is bowed, all in unison, to one side of the wwale line with an 8-course repeat, giving the groupings a scalloped appearance which is very apparent in Fabric II-C but less so in Fabric II-D. Fabrics II-E and II-F have the 3×2×2 wale groupings of Fabrics II-A and II-B, the wales being more tightly shifted together within the groupings of Fabric II-F. These fabrics also exhibit a slight scalloping of the wales as seen in Fabrics II-C and II-D.

which groups of three adjacent wales are shifted close together and the groups are separated by four normally knit and spaced wales. Fabrics III-A (R = 1.29 ) and III-B (R = 1.45 ) are almost identical in patterning but completely different from Fabric III-C. In each the patterning of consecutive wales is as follows: Two wales of alternating large and small loops flank a normally knit wale and are wale-shifted away from it to provide widened relatively open spaces. This 3-wale pattern is repeated in every group of seven wales across the width of the fabric. The intervening groups of 4 wales each also wale-shift slightly such that the two outside wales in each group of four are very close to the 3-wale patterns and slightly spaced apart from the two remaining central wales. These fabrics exhibit a pleasing surface patterning not heretofore obtainable in basic Jersey warp knitting.

Delaware stitch Fabric III-D (R = 0.79 ) is substantially identicaly in appearance to the one shown in FIG. 5; i.e., it has repeating 3×2×2 wale-shifted groupings

TABLE 1

KNITTING PARAMETERS

| Fabric No. | Yarns Top Beam | Middle Beam | Back Beam | Runner Lengths (in.) Top | Middle | Back | Runner Lengths(m) Top | Middle | Back | Stitch | Quality | R |
|---|---|---|---|---|---|---|---|---|---|---|---|---|
| I-A | A | A | A | 62.5 | 56 | 36.5 | 1.588 | 1.422 | .927 | (1) | * | 0.90 |
| I-B | A | A | A | 62 | 54 | 30.5 | 1.575 | 1.372 | .775 | (2) | * | 0.87 |
| I-C | A | A | A | 73.5 | 58.75 | 30.25 | 1.867 | 1.492 | .768 | (3) | * | 0.80 |
| II-A | B | C | B | 67 | 50.5 | 35 | 1.702 | 1.283 | .889 | (2) | ** | 0.75 |
| II-B | B | A | B | 67 | 50.5 | 35 | 1.702 | 1.283 | .889 | (2) | ** | 0.75 |
| II-C | B | C | B | 80.25 | 52.25 | 31 | 2.038 | 1.327 | .787 | (4) | * | 0.65 |
| II-D | B | A | B | 80.25 | 52.25 | 31 | 2.038 | 1.327 | .787 | (4) | * | 0.65 |
| II-E | B | C | B | 64.5 | 50 | 30 | 1.638 | 1.270 | .762 | (5) | * | 0.78 |
| II-F | B | A | B | 64.5 | 50 | 30 | 1.638 | 1.270 | .762 | (5) | * | 0.78 |

* 6 in. (15.2 cm.)
** 8.25 in. (21.0 cm.)
(1) Jersey stitch 2–3, 1–0/1–0, 1–2
(2) Delaware stitch 2–3,1–0/1–0,0–1
(3) Long-float Delaware stitch 3–4,1–0/1–0,0–1
(4) Modified Delaware stitch 4–3,1–0(3–4,1–0) × 2;3–4,6–7/1–0,1–0(1–0,0–1) × 2;1–0,1–0
(5) Modified Delaware stitch 3–2,1–0(2–3,1–0) × 2;2–3,4–5/0–1,1–0(1–0,0–1) × 2;1–0,1–0

TABLE 2

FABRIC CHARACTERIZATIONS

| Fabric No. | Finished Fabric Weight oz/yd² | gm/100 cm² | Width in. | m. | Count(W/C) in.⁻¹ | cm.⁻¹ | Bulk cc/gm | Greige Fabric Weight oz/yd² | gm/100 cm² | Bulk cc/gm |
|---|---|---|---|---|---|---|---|---|---|---|
| I-A | 2.3 | .781 | 67.5 | 1.715 | 39 × 67 | 15.4 × 26.4 | 4.91 | 2.4 | .814 | 6.46 |
| I-B | 2.4 | .814 | 78.88 | 2.004 | 34 × 90 | 13.4 × 35.4 | 6.45 | 2.0 | .678 | 7.16 |
| I-C | 2.7 | .916 | 78.5 | 1.994 | 34 × 88 | 13.4 × 34.6 | 4.36 | 2.5 | .848 | 6.28 |
| II-A | 1.88 | .638 | 41.88 | 1.064 | 33 × 70 | 13.0 × 27.6 | 6.53 | 1.67 | .567 | 7.29 |
| II-B | 2.10 | .713 | 74.5 | 1.892 | 35 × 75 | 13.8 × 29.5 | 6.35 | 1.71 | .580 | 5.26 |
| II-C | 2.41 | .818 | 41.32 | 1.050 | 33 × 90 | 13.0 × 35.4 | 5.31 | 2.58 | .876 | 7.26 |
| II-D | 2.83 | .960 | 72.75 | 1.848 | 38 × 88 | 14.9 × 34.6 | 6.56 | 2.5 | .848 | 6.35 |
| II-E | 2.24 | .760 | 41.75 | 1.060 | 33 × 92 | 13.0 × 36.2 | 6.69 | 2.16 | .733 | 7.59 |
| II-F | 2.62 | .889 | 75.5 | 1.918 | 35 × 100 | 13.8 × 39.4 | 6.89 | 2.10 | .713 | 7.31 |

EXAMPLE III

Nine additional fabrics are prepared to illustrate wale-shifted surface patterning efects for R greater than unity, and to compare with fabrics knitted at R less than unity. Yarn A is used in all three beams. The back guide bar is fully threaded from the bottom beam, and the front guide bar is fully threaded from the top and middle beams. In the front guide bar, every seventh end comes from the middle beam, and the intervening groups of six ends comes from the top beam. Fabrics III-A, -B, and -C use the Jersey stitch, FIG. 1A; Fabrics III-D, -E, and -F use the Delaware stitch, FIG. 1H; and Fabrics III-G, -H, and -I use the Long Float Delaware stitch, FIG. 1I.

Considering the Jersey fabrics first, Fabric III-C (R = 0.82 ) has a pattern, repeated across its whole width, in separated by relatively open interwale spacings. Fabrics III-E (R = 1.23 ) and III-F (R = 1.29 ) are indistinguishable from one another but differ from Fabric III-D in that 2×1×2×2 repetitive patterns of wale-shifted groupings occur across their widths.

Long Float Delaware stitch Fabric III-G (R = 0.75 ) is substantially identical in appearance to the one shown in FIG. 6; i.e., it has repeating 4×3 wale-shifted groupings separated by relatively open interwale spacings. Fabrics III-H (R = 1.07 ) and III-I (R = 1.21 ) are very similar to each other in patterning but strikingly different from Fabric III-G. The relatively open interwale spacings formed by wale-shifting are not each as wide as in Fabric III-G, but are more numerous. The repeated pattern of groupings in each case is 2×1×1×2×1. Fabric III-I is considerably more distinctly patterned than is Fabric III-H.

It is shown for this mixed-feed technique that:

1. limited overfeeding of the minor partial beam produces excellent wale-shifted patterning;
2. patterns formed with R greater than unity differ from those formed with R less than unity; and
3. as R approaches unity with identical feed yarns, patterning becomes less distinct.

TABLE 3

KNITTING PARAMETERS

| Fabric No. | Yarns Top Beam | Yarns Middle Beam | Yarns Back Beam | Runner Lengths (in.) Top | Runner Lengths (in.) Middle | Runner Lengths (in.) Back | Runner Lengths (m.) Top | Runner Lengths (m.) Middle | Runner Lengths (m.) Back | Quality (in.) | Quality (cm.) | R |
|---|---|---|---|---|---|---|---|---|---|---|---|---|
| III-A | A | A | A | 56 | 72.5 | 43 | 1.422 | 1.842 | 1.092 | 8.25 | 21.0 | 1.29 |
| III-B | A | A | A | 58 | 84 | 43 | 1.473 | 2.134 | 1.092 | 8.25 | 21.0 | 1.45 |
| III-C | A | A | A | 60 | 49.5 | 43 | 1.524 | 1.257 | 1.092 | 8.25 | 21.0 | 0.82 |
| III-D | A | A | A | 57 | 45 | 31.5 | 1.448 | 1.143 | 0.800 | 6 | 15.2 | 0.79 |
| III-E | A | A | A | 53 | 65 | 31.5 | 1.346 | 1.651 | 0.800 | 6 | 15.2 | 1.23 |
| III-F | A | A | A | 55 | 71 | 31.5 | 1.397 | 1.803 | 0.800 | 6 | 15.2 | 1.29 |
| III-G | A | A | A | 76 | 57 | 31.5 | 1.930 | 1.448 | 0.800 | 6 | 15.2 | 0.75 |
| III-H | A | A | A | 68 | 73 | 31.5 | 1.727 | 1.854 | 0.800 | 6 | 15.2 | 1.07 |
| III-I | A | A | A | 70 | 85 | 31.5 | 1.778 | 2.159 | 0.800 | 6 | 15.2 | 1.21 |

TABLE 4

FABRIC CHARACTERIZATIONS

| Fabric No. | Finished Fabric Weight oz./yd.² | Finished Fabric Weight gm./100 cm.² | Finished Fabric Width in. | Finished Fabric Width m. | Finished Fabric Count (W/C) in.⁻¹ | Finished Fabric Count (W/C) cm.⁻¹ | Finished Fabric Bulk cc/gm. | Greige Fabric Weight oz./yd.² | Greige Fabric Weight gm./100 cm.² | Greige Fabric Bulk cc/gm. |
|---|---|---|---|---|---|---|---|---|---|---|
| III-A | 2.4 | .814 | 58.75 | 1.492 | 45 × 62 | 17.7 × 24.4 | 5.24 | 2.04 | .692 | 4.78 |
| III-B | 2.4 | .814 | 60.12 | 1.527 | 43 × 64 | 16.9 × 25.2 | 6.25 | 2.37 | .804 | 5.37 |
| III-C | 2.4 | .814 | 59.5 | 1.511 | 44 × 62 | 17.3 × 24.4 | 4.58 | 2.17 | .736 | 5.18 |
| III-D | 2.3 | .781 | 72.75 | 1.848 | 36 × 90 | 14.2 × 35.4 | 4.71 | 2.40 | .814 | 5.00 |
| III-E | 2.5 | .848 | 72.75 | 1.848 | 36 × 95 | 14.2 × 37.4 | 4.68 | 2.40 | .814 | 4.67 |
| III-F | 2.4 | .814 | 73.5 | 1.867 | 37 × 91 | 14.6 × 35.8 | 5.31 | 2.09 | .709 | 5.74 |
| III-G | 2.8 | .950 | 75.5 | 1.918 | 36 × 93 | 14.2 × 36.6 | 5.07 | 1.91 | .648 | 5.87 |
| III-H | 2.8 | .950 | 73.12 | 1.857 | 37 × 90 | 14.6 × 35.4 | 4.45 | 2.02 | .686 | 5.20 |
| III-I | 2.8 | .950 | 73.62 | 1.870 | 37 × 90 | 14.6 × 35.4 | 5.31 | 1.99 | .675 | 4.89 |

I claim:

1. In a method for producing warp knitted fabrics on a warp knitting machine having at least two full sets of warp threads, including the steps of feeding one of said two full sets of threads to one of two operating guide bars of said warp knitting machine and feeding the other of said two full sets to the other operating guide bar of said warp knitting machine to form a knitted fabric, there being only one thread in each guide of each operating guide bar, the improvement comprising: supplying one of said full sets of threads from two partial beam sets of threads, said two partial beam sets of threads being fed at different rates to said operating guide bar in a pattern, said pattern being predetermined groups of adjacent threads from one partial beam set of threads, each group being separated by at least one thread from the other partial beam set of threads.

2. The method of claim 1, said pattern being repeating groups of three threads from said one partial beam set separated by one thread from said other partial beam set of threads.

3. The method of claim 1, said pattern being repeating groups of four threads from said one partial beam set separated by one thread from said other partial beam set of threads.

4. The method of claim 1, said pattern being repeating groups of five threads from said one partial beam set separted by one thread from said other partial beam set of threads.

5. The method of claim 1, said pattern being repeating groups of six threads from said one partial beam set separated by one thread from said other partial beam set of threads.

6. The method of claim 1, said pattern being repeating groups of seven threads from said one partial beam set separated by one thread from said other partial beam set of threads.

7. The method of claim 1, said pattern being repeating groups of eight threads from said one partial beam set separated by one thread from said other partial beam set of threads.

8. The method of claim 1, said pattern being repeating groups of nine threads from said one partial beam set separated by one thread from said other partial beam set of threads.

9. The method of claim 1, said warp knitting machine being a single needle bed machine haivng front and back guide bars, one of the two operating guide bars being the front guide bar of the warp knitting machine, said two partial beam sets of threads being fed to said front guide bar.

10. The method as defined in claim 9, the two partial beam sets of threads being fed at different rates from each other to provide a ratio R of runner lengths between the two partial beam sets of threads in the range of from about 0.5 to about 1.5.

* * * * *

UNITED STATES PATENT OFFICE

CERTIFICATE OF CORRECTION

PATENT NO. : 4,026,130

DATED : May 31, 1977

INVENTOR(S) : Bharat Jaybhadra Gajjar

It is certified that error appears in the above-identified patent and that said Letters Patent are hereby corrected as shown below:

Col. 1, line 53, Change "diamgrams" to -- diagrams --

Col. 2, line 11, Change "particualarly" to -- particularly --

Col. 5, line 11, Change "outer" to -- other --

Col. 6, line 6, Change "grouping" to -- groupings --

Col. 6, line 23, Change "for" to -- of --

Col. 6, line 27, Insert -- and -- after "together"

Col. 6, line 31, Change the formula "X2X2" to -- 3X2X2 --

Col. 6, line 42, Change "4wale" to -- 4-wale --

Col. 7, line 13, Change "wwale" to -- wale --

Col. 8, line 19, Change "identicaly" to -- identical --

Col. 10, line 5, Change "separted" to -- separated --

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarl*